United States Patent [19]

Hughes

[11] 3,937,549

[45] Feb. 10, 1976

[54] STRIMP

[75] Inventor: Donald Kent Hughes, Mechanicsburg, Pa.

[73] Assignee: AMP Incorporated, Harrisburg, Pa.

[22] Filed: June 18, 1974

[21] Appl. No.: 480,986

[52] U.S. Cl. ..... 339/97 C; 339/276 T

[51] Int. Cl.[2] ..... H01R 13/38

[58] Field of Search ..... 339/95, 97–99, 339/276

[56] References Cited

UNITED STATES PATENTS

| | | | |
|---|---|---|---|
| 3,145,261 | 8/1964 | Forney, Jr. | 339/98 |
| 3,320,354 | 5/1967 | Marley et al. | 339/98 |
| 3,377,611 | 4/1968 | Pawl | 339/97 P |
| 3,596,236 | 7/1971 | Schlesinger, Jr. | 339/276 R |
| 3,683,319 | 8/1972 | Vigeant et al. | 339/97 R |
| 3,760,335 | 9/1973 | Roberts | 339/99 R |

*Primary Examiner*—Joseph H. McGlynn
*Attorney, Agent, or Firm*—Russell J. Egan, Esq.

[57] ABSTRACT

An improved slotted beam type electrical contact for engaging stranded wire is disclosed. The subject contact includes an insulation displacement feature which obviates the need for stripping the end of wire. It also assures good electrical and mechanical connection with the individual strands of the wire, regardless of the stranding or the lay of the strands, by the arrow head shape of the slot. The beams are retained in contact with the strands of wire by locking legs which, after the engagement of a stranded wire conductor therein, are deformed to prevent subsequent spreading of the beams.

17 Claims, 9 Drawing Figures

STRIMP

BACKGROUND OF THE INVENTION

The Field Of The Invention

The present invention relates to an improved insulation piercing contact for use with stranded wire and in particular to a slotted beam type of contact which will assure a rigid closure of the contact at the completion of the wire engaging operation.

The Prior Art

There are a number of well known slotted beam type contacts presently available in the market place and well described in the related prior art. Most of these known slotted beam contacts have an inherent problem in that the beams are formed by a pair of rigid, substantially parallel cantilever members. When a wire or a conductor formed by a plurality of stranded wires is inserted into the slotted beam, one of two things usually happens. If the beam legs are sufficiently rigid, the sides of the beams bite into the wire. This is generally acceptable in the case of solid wire but is generally unacceptable for stranded wire since such a bite could case severing of one or more of the wire strands thereby decreasing the mechanical and electrical effects of the contact. If the cantilever legs of the slotted beam are not excessively rigid, they can flex outwardly when a wire is inserted therein to produce the undesirable effect of not having adequate pressure to form good mechanical connection with the wire. This is particularly noticeable with stranded wire since any untwisting or loosening of the stranded bundle could result in the conductor becoming separated from the contact, thereby losing all mechanical and electrical connection therewith.

SUMMARY OF THE INVENTION

The subject electrical contact is of the slotted beam type and is designed for engaging insulated stranded wire conductors by piercing the insulation to electrically and mechanically engage the metallic wire strands enclosed therein. The contact has a conductor engaging portion and a portion mateable with other electrical contacts. The conductor engaging portion includes a base with a pair of beam members extending normal to the base and defining an arrow head shaped wire receiving slot therebetween, a pair of arched leg members spaced outwardly of the beam members and connected between the base and the free end of the beam members. The base, each arched leg member and the related beam member constitute a four-sided geometric figure which, after insertion of a wire into the slot, is deformed into a substantially triangular figure, by straightening the leg members whereby the beam members are retained in a closed condition.

It is therefore an object of the present invention to produce an improved electrical contact of the insulation displacing slotted beam type which will provide good mechanical and electrical engagement with stranded wire.

It is a further object of the present invention to produce an improved electrical contact having arched leg members which are deformed upon assembly of the contact with a wire to assure that the slotted beam portion of the contact remaining in gripping engagement with the wire.

It is a further object of the present invention to produce an electrical contact which will not require prestripping of the wire to be engaged therein, but will provide insulation piercing connection therewith regardless of the stranding or lay of strands forming the wire.

It is yet another object of the present invention to produce an improved electrical contact of the slotted beam type which will strip insulation from a conductor, contain strands forming the conductor, and, upon closure of the beams, cause cold flow of the strands while deforming arch shaped legs to assure closure of the beams with a minimum of spring back.

It is a still further object of the present invention to produce an improved electrical contact of the slotted beam type which may be readily and economically manufactured.

The means for accomplishing the foregoing and other objects and advantages, which will be apparent to those skilled in the art, are set forth in the following detailed description of a preferred embodiment taken with reference to the accompanying drawings.

DETAILED DESCRIPTION OF THE PREFERRED EMBODIMENT

Figure 1:
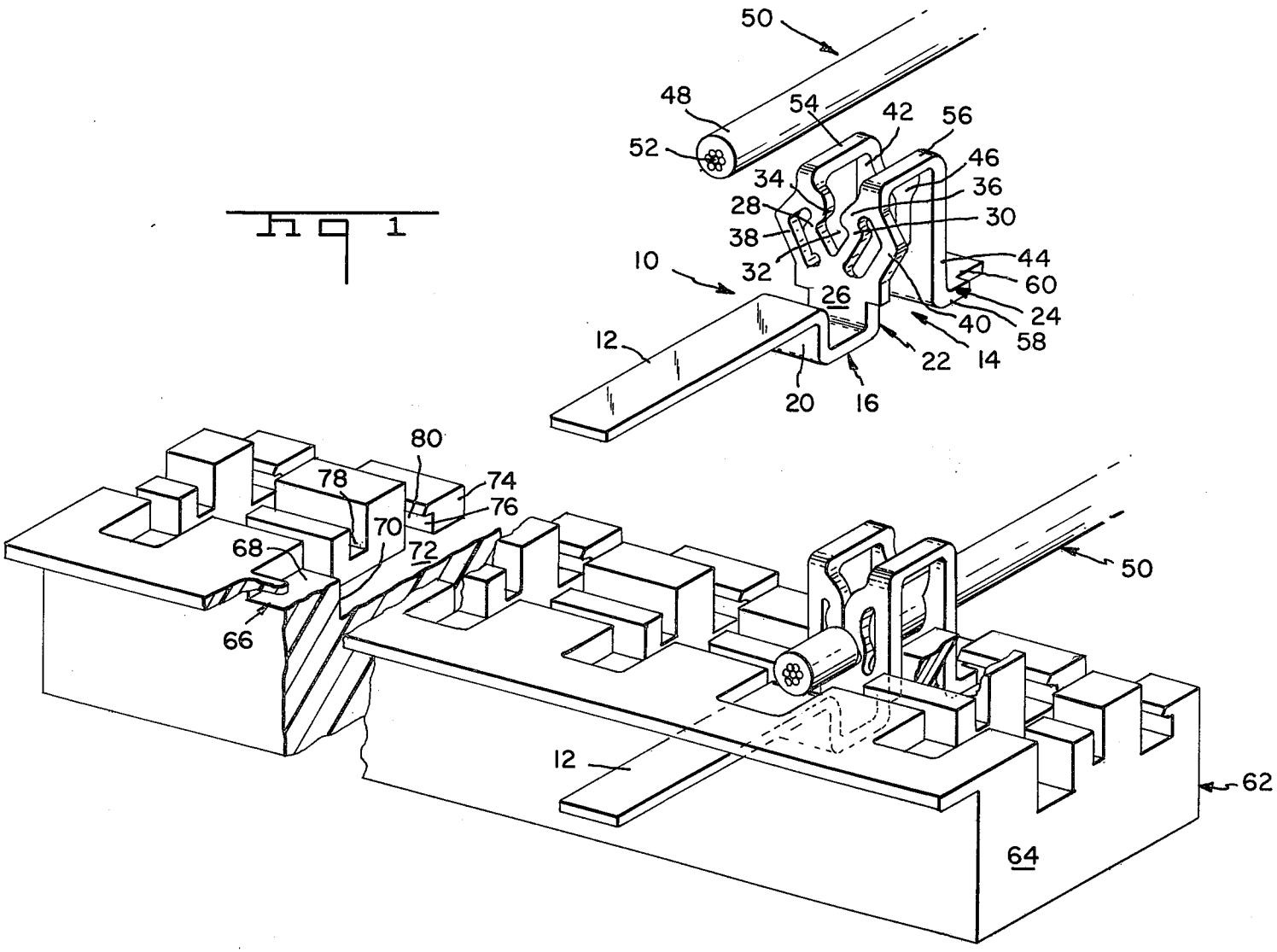
FIG. 1 is an exploded perspective view of an embodiment of the subject electrical contact together with conductors and a representative housing.

In the following description like parts will be identified with like reference numerals throughout the sequence of drawings. Turning now to FIG. 1, the subject contact is generally noted by reference numeral 10 and includes a contact mateable portion 12 and a conductor engaging portion 14. The contact mateable portion 12 has been schematically represented by a simple blade projecting from the main body 16 of the contact. It is to be understood that this mateable portion can be of any of the well known pin or receptacle configurations and can include mounting means such as step 20 or locking lances (not shown). The conductor engaging portion 14 is here shown with a wire engaging portion 22 and an insulator engaging portion 24 serving for strain relief. The main body 16 includes a base 26 with a pair of beam members 28, 30 extending upwardly therefrom. The beams define therebetween an arrowhead shaped opening 32 which is closed at the bottom and terminated at the top by insulation displacing projections 34, 36. To the outside of each of the beam members 28, 30 there is located an arched leg member 38, 40 the lower ends of which are integral with the base 26 and the upper ends which are attached to the upper ends of the beam members 28, 30. The strain relief portion 24 is spaced rearwardly of and parallel to the conductor engaging slotted beam portion 22. The strain relief portion includes a pair of beam members 42, 44 defining an insulation engaging slot 46 therebetween. The second slot 46 is of somewhat greater dimension than the slot 32 and is adopted to grasp the insulation 48 of the conductor 50 without piercing the insulation to engage the stranded wires 52 therein. The upper ends of beams 42, 44 are connected to the upper ends of beams 28, 30 by bridge members 54, 56, respectively, while their lower ends are integral with rear base member 58. Base member 58 is provided with a mounting shoulder 60.

The embodiment of the housing 62 which has been illustrated is simply representative of a housing which will suitably receive the embodiment of the subject contact described above. The housing 62 includes a base portion 64 having a plurality of profiled contact receiving passages 66 extending therethrough. Each passage has a forward aperture 68 through which the mating portion 12 of the contact extends and a step 70 against which the step 20 abuts. The body receiving portion 72 of the passage has a narrowed rear exit 74, defined by shoulders 76 and transverse channels 78, 80 interconnecting the passages. Each contact is mounted in the housing with blade 12 extending through aperture 68, steps 20 and 70 engaging and shoulders 60, 76 engaging. Arched legs 38, 40 can extend into the transverse channel 78 to either side of each passage.

Figure 2:
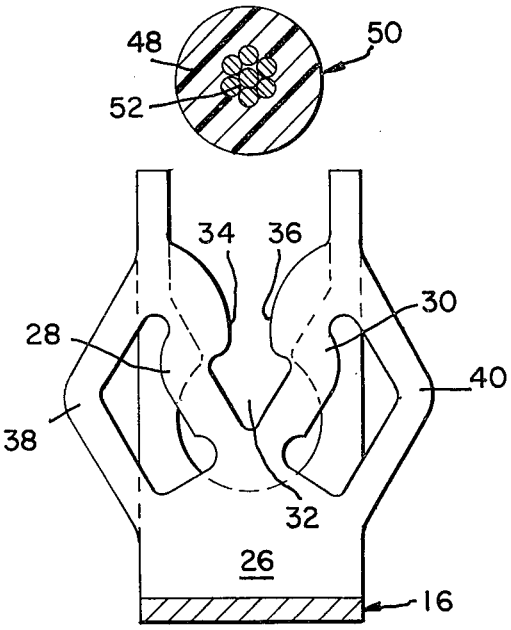
FIGS. 2–5 are diagrammatic end views showing the steps of insertion of a conductor into the subject contact and the subsequent closure thereof.
Figure 3:
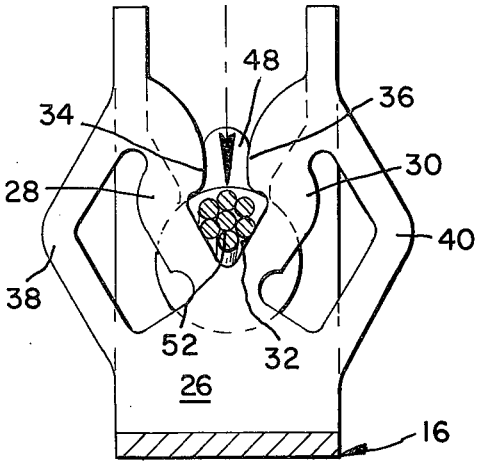

The sequential steps of insertion of a wire into the subject contact will be described with reference to FIGS. 2 to 5. In FIG. 2, the contact is shown in the open condition with a stranded wire conductor 50 positioned thereabove. In FIG. 3, the conductor 50 has been moved downwardly into the contact with the projections 34, 36 having pierced the insulation 48 and stripped it from the bundle of stranded wires 52. The stranded bundle is received in the slot 32 as shown. The upper ends of the beam members 28, 30 are brought together, in the manner shown in FIG. 4, by pressure directed inwardly against the upper ends of the beams as noted by the arrows. It will be seen that during this motion the strands 52 are compressed and to a certain extent cold flow to form a good mechanical and electrical connection at this point. With certain types of materials it is also possible to achieve cold welding of the strands and contact by this movement. The continued locking of the contact is effected by pressure against the arched legs 38, 40, as noted by arrows in FIG. 5 to substantially straighten the legs to assume a generally triangular configuration defined by a portion of the base 26, the related beam member 28, 30 and associated now straightened leg 38, 40. Since it is well known that a triangle is the most rigid of geometric figures, it will be quite clear that the straightening of the arched leg to form this triangle will produce a very rigid configuration in which any resilient opening of the closed contact is substantially prevented.

The arrow head shape of slot 32 serves an important function during the attachment of the subject contact to a stranded wire conductor. The slot profile allows some of the strands to move all the way to the bottom of the arrow tip while the rest of the strands are pushed below the projections 34, 36. These projections hold the strands down and, as the beams are driven together, prevent egress of the strands from the slot. Thus the strands are compacted and compressed during the beam closing action until substantially no air gaps remain between the separate strands. The slot is, of course, sized according to the size of the conductor so that neither cutting of the strands nor a loose engagement with the conductor will occur.

Figure 9:
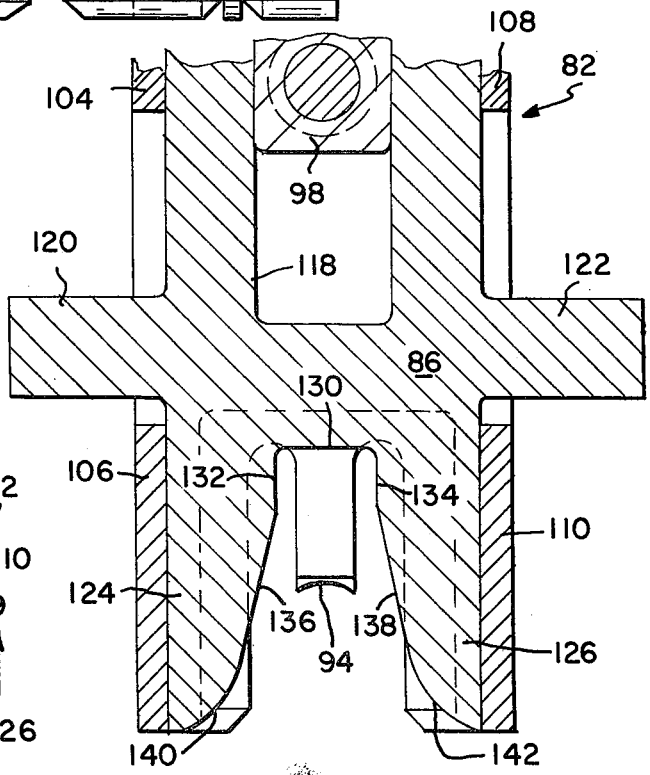
FIG. 9 is a vertical section taken along line 9—9 of FIG. 8.

A tool suitable for assembly of the above described contact with a conductor is shown in FIGS. 6 to 9. The tool is comprised essentially of three members, namely the block or housing 82, the face plate 84, and the crimp blade 86. The block 82 is adapted to be mounted on suitable tooling, not shown, by conventional means, also not shown, but schematically represented by bore 88. The block includes a channel 90 extending longitudinally therethrough and a second passage 92 extending transversely therethrough spaced from the crimping end of the block. A wire engaging holding member 94 depends downwardly into the forward portion of the channel 90 giving it somewhat of an M shape configuration which projects slightly from the face of the block. A mounting stud 98 also extends forwardly of the face 96 of the block. The edges of the face 96 are profiled to form steps 100, 102. The face plate 84 has four integral leg portions 104, 106, 108 and 110 which engage in steps 100, 102. The rear face 112 of the face plate engages upon the end of mounting stud 98 to hold the face plate 84 fixed to the block with faces 96 and 112 spaced apart to provide ample room for the reciprocal movement of the ram 86 therebetween. The face plate 84 is also provided with an aperture 114 through which a bolt, not shown, is passed to threadingly engage the stud 98 to secure the face plate on the block. The face plate 84 also includes a front channel 116 which projects slightly to the rear of face 112, in the manner of channel 94. The ram 86 includes a central aperture 118 through which the stud 98 passes. A pair of laterally extending arms 120, 122 project outwardly from either side of the ram and extend beyond the block 82 between the legs 104, 106, 108, and 110. These arms are attached to a drive mechanism, not shown, which will effect the reciprocal movement of the ram. The ram further includes a pair of downwardly depending leg members 124, 126 which have therebetween a cam web 128. The cam web 128 is somewhat thinner than the remainder of the ram 86 and will ride over the channels 94, 116. As best seen in FIG. 9, the cam web 128 has a channel shape base portion defined by wall 130 and walls 132, 134 extending normally therefrom. A pair of walls 136, 138 connect with the walls 132, 134 respectively and are flared outwardly diverging from the base 130. The bottom ends of the walls 136, 138 include smooth arced portions 140, 142 tapering over to the side legs 124, 126 respectively.

Figure 4:
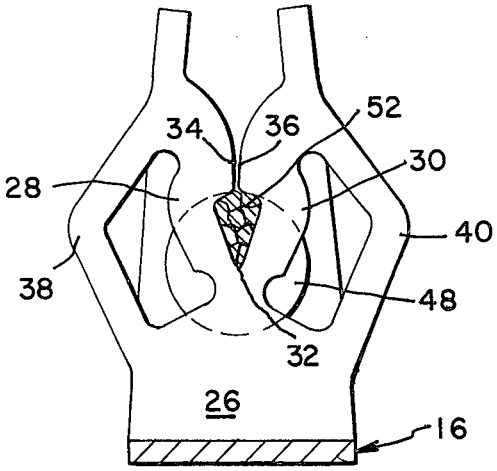
Figure 5:
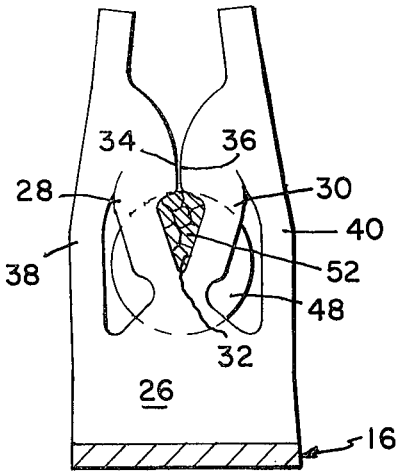
Figure 6:
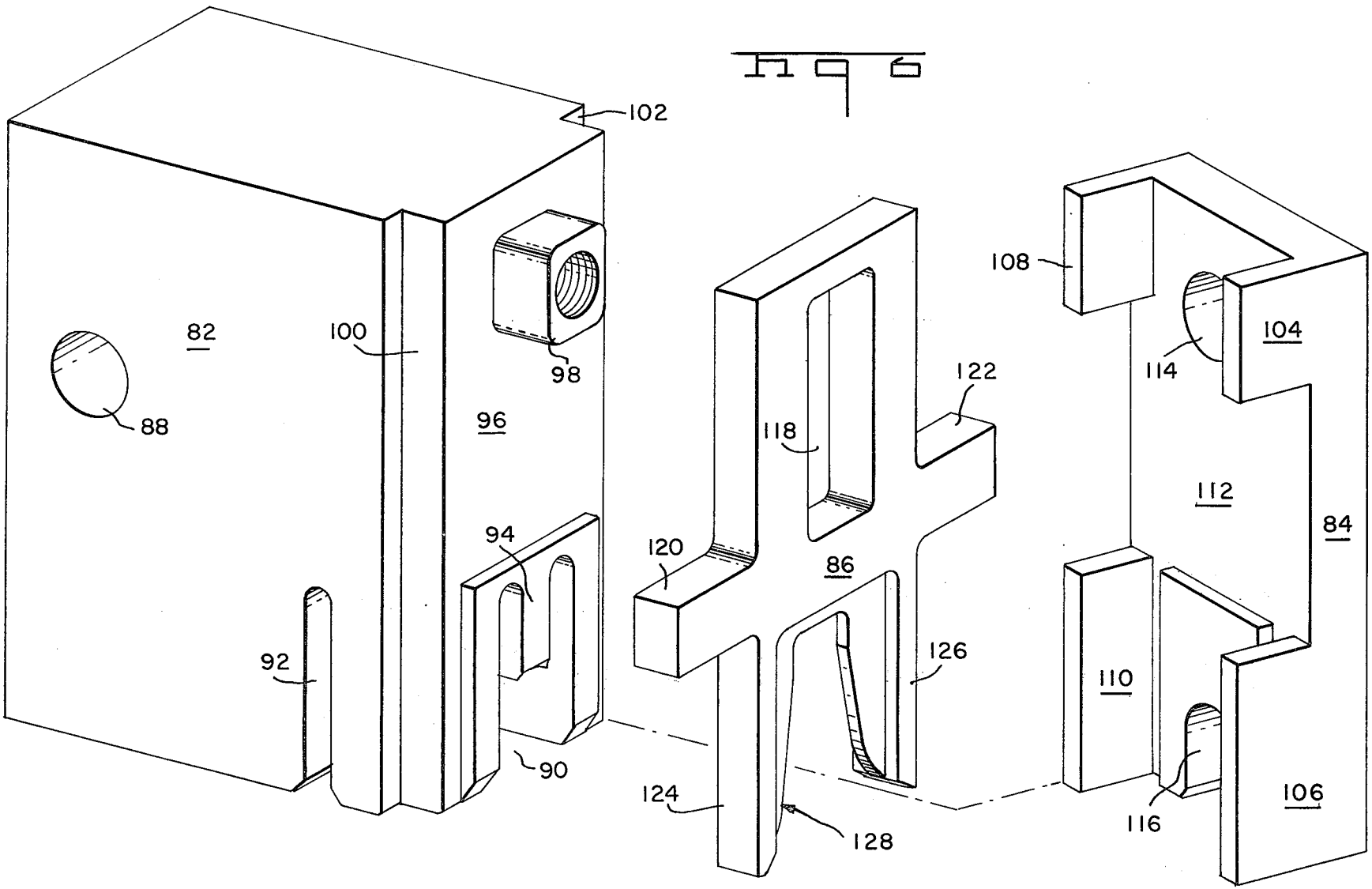
FIG. 6 is an exploded perspective view of a tool for assembling the subject contact onto associated conductors.
Figure 7:
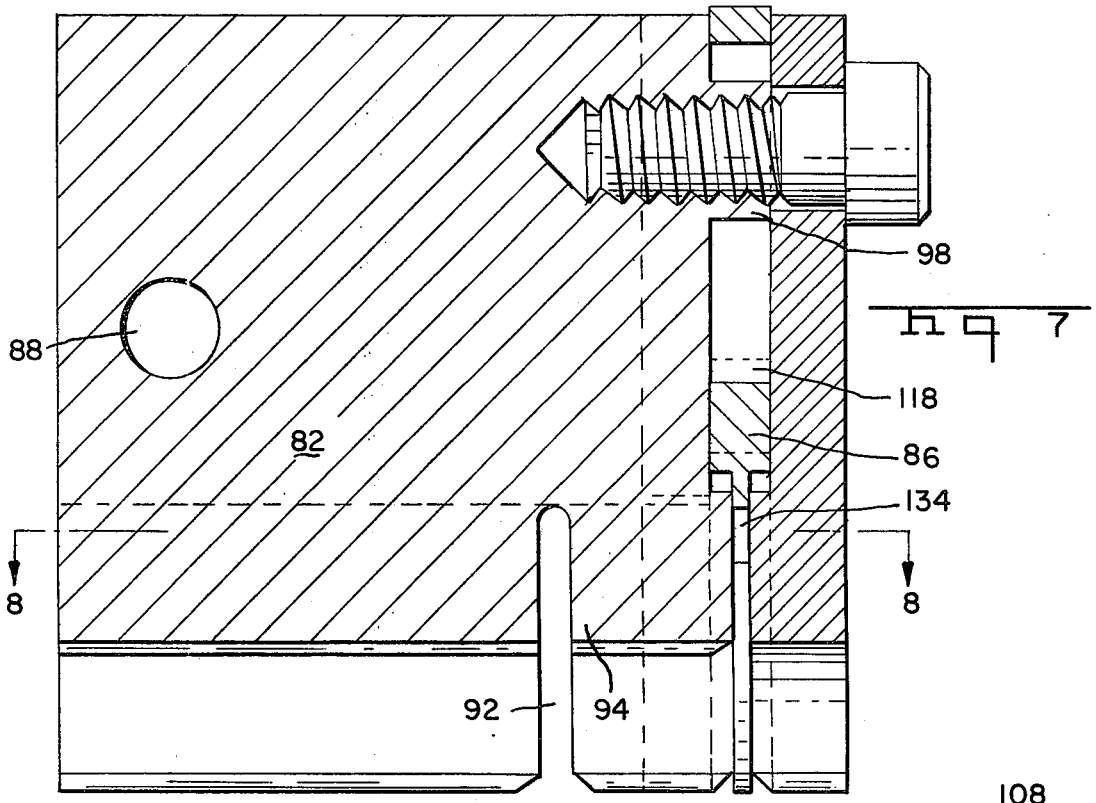
FIG. 7 is a longitudinal vertical section through the tool of FIG. 6.
Figure 8:
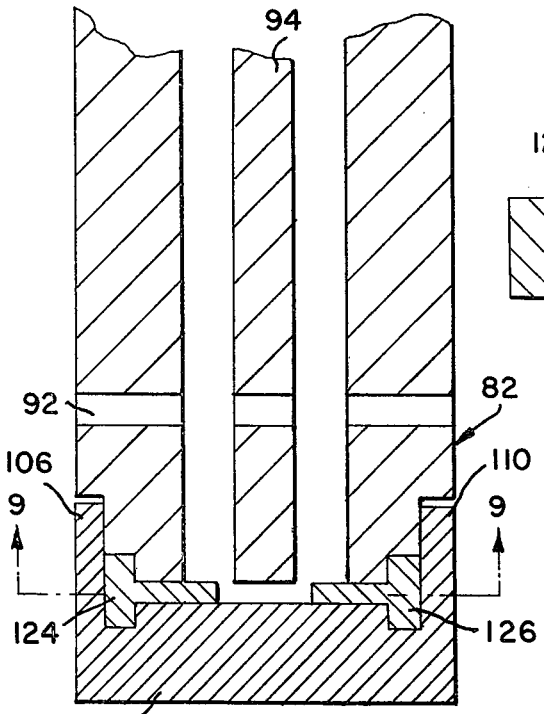
FIG. 8 is a horizontal section taken along line 8—8 of FIG. 7.

The above described tool is used with connection with an anvil or base, not shown. The conductor 50 is fed through the channel 90 to extend beyond the face plate 84. A contact 10 according to the present invention is inserted into the channel above an anvil, not shown. The tool is driven downwardly so that the projection 94 drives the conductor initially into the slots 32, 46 with the projections 34, 36 preforming the above described insulation displacement stripping of the insulation from the wire strands. The ram 86 is subsequently driven downwardly with the side walls 136, 138 making initial contact with the upper ends of the beams 28, 30 to drive them toward one another, as shown in FIG. 4. The continued downward movement of the ram causes the inclined walls 136, 138 to engage and at least partially straighten the arched legs 38, 40, as shown in FIG. 5. This straightening of the arched legs establishes the above discussed triangular configuration and the desired rigidity of the assembled contact.

The present invention has been described in relation to a single preferred embodiment of the contact and tooling suitable for the assembly thereof with stranded wire. It is to be understood that the present invention may be subject to many modifications and changes without departing from the spirit or essential characteristics thereof.

What is claimed is:

1. An electrical contact comprising:

a metallic member having a conductor engaging portion and a mateable contact engaging portion, said conductor engaging portion comprising a base, a pair of spaced beam members extending from said base, a protrusion near the free end of each said beam member directed towards the protrusion on the opposite beam member, said protrusions and beam members defining therebetween an arrow head shaped slot, and a pair of arched legs, each leg connected between said base and the free end of one of said beam members to define therewith a quadrilateral whereby said beam members are held together against resilient deflection away from a conductor inserted into said slot by substantially straightening said arched legs to form a triangle with said base and beam members.

2. An electrical contact according to claim 1 wherein said protrusions serve to pierce and displace insulation from an insulated conductor inserted therein.

3. An electrical contact according to claim 1 wherein said mateable contact engaging portion comprises:

a male pin.

4. An electrical contact according to claim 1 wherein said mateable contact engaging portion comprises:

a female receptacle.

5. An electrical contact according to claim 1 further comprising strain relief means parallel to and spaced from said conductor engaging portion, said strain relief means comprising a pair of parallel spaced beam members joined together at one end and a pair of bridge members each joining the free end of one of said beam members to the free end of a corresponding conductor engaging beam member, said strain relief beam members defining therebetween a slot having dimensions substantially the same as the outer dimensions of the conductor inserted therein whereby the insulation of said conductor will be grasped but not pierced by said strain relief beams as they are bent together.

6. An electrical contact according to claim 1 further comprising:

means fixedly mounting said contact in a connector housing.

7. An electrical contact according to claim 6 wherein said contact mounting means comprises:

locking lances engageable with detents in said housing.

8. An electrical contact according to claim 6 wherein said contact mounting means comprises:

shoulders engageable with like shoulders in said housing.

9. An electrical contact according to claim 6 wherein said contact mounting means comprises:

steps engageable with like steps in said housing.

10. An improved electrical contact of the slotted beam type comprising:

a unitary metallic member stamped and formed from a continuous strip of metal and including a conductor engaging portion and a mateable contact engaging portion, said conductor engaging portion including a base, a pair of spaced beam members extending from said base with inwardly directed protrusions near the upper ends of said beam members and with said members defining a substantially arrow head shaped slot therebetween, and an arched shaped leg outwardly positioned of each said beam members integrally attached at opposite ends to said base and the free end of the respective beam member to form a quadrilateral therewith whereby upon straightening of said arched leg a substantially triangular configuration is formed resulting in a rigid closed slotted beam.

11. The electrical contact according to claim 10 wherein:

said mateable contact engaging portion is a male pin.

12. The electrical contact according to claim 10 wherein:

said mateable contact engaging portion is a female receptacle.

13. The electrical contact according to claim 10 further comprising:

locking means adapted to fixedly mount said contact in an associated connector housing.

14. The electrical contact according to claim 10 further comprising:

strain relief means including a pair of beam members joined together at one end defining a slot therebetween which is substantially the same width as the outer diameter of the conductor to be received therein, and a pair of bridge members each connecting the free end of one of said strain relief beam members to the free end of the corresponding conductor engaging beam member, whereby when said conductor engaging beams are driven together said strain relief beams tightly engage but do not pierce the insulator sheath of said conductor.

15. The electrical contact according to claim 14 wherein said strain relief means is parallel to and spaced from said conductor engaging portion.

16. An electrical connector comprising:

a housing having a plurality of contact receiving passageways therein, and a like plurality of contacts each mounted in a respective passageway of said housing, each said contact comprising an integral metal member having a conductor engaging portion and a mateable contact engaging portion, said conductor portion comprising a base, a pair of beam members extending from said base defining therebetween a slot having an arrow head configuration, and a pair of arched legs each connected between said base and the free end of a respective beam member to define a quadrilateral which, upon substantial straightening of said arched leg, becomes a triangle resisting separation of said beam members.

17. A method of engaging a stranded wire conductor with an electrical contact of the slotted beam type having a pair of beams extending from a base defining an arrow head shaped slot therebetween and a pair of arched legs each connected between said base and the free end of a respective beam to define a quadrilateral, comprising the steps of:

inserting said conductor into said slot with the narrow opening thereof performing an insulation piercing and displacing operation, driving the free ends of said beams together to substantially close the opening of said arrow head shaped slot to prevent egress of said strands, by substantially straightening said arched legs to form a triangle with said beams and said base whereby resilient outward displacement of said beams is prevented.

* * * * *